US005538100A

United States Patent [19]

Hedley

[11] Patent Number: 5,538,100

[45] Date of Patent: Jul. 23, 1996

[54] ACCESS DEVICE

[76] Inventor: Robert I. Hedley, Lot 23 Pully Road Milbrodale, Via Singleton, 2330 New South Wales, Australia

[21] Appl. No.: 276,441

[22] Filed: Jul. 18, 1994

[30] Foreign Application Priority Data

Jul. 16, 1993 [AU] Australia ..... PL9979

[51] Int. Cl.[6] ..... E06C 5/22

[52] U.S. Cl. ..... 182/97; 182/127

[58] Field of Search ..... 182/97, 98, 93, 182/127, 96, 85; 280/166

[56] References Cited

U.S. PATENT DOCUMENTS

| | | | |
|---|---|---|---|
| 974,781 | 11/1910 | Finkelstein | 182/974 |
| 3,869,022 | 3/1975 | Wallk | 182/98 |
| 4,476,957 | 10/1984 | Ory | 182/974 |
| 5,174,411 | 12/1992 | Oliver | 182/98 X |

FOREIGN PATENT DOCUMENTS

| | | | |
|---|---|---|---|
| 32223 | 6/1962 | Finland | 182/98 |

*Primary Examiner*—Alvin C. Chin-Shue

*Attorney, Agent, or Firm*—Hopgood, Calimafde, Kalil & Judlowe

[57] ABSTRACT

An access device, such as a ladder, which is retractable, to provide access between a first position, and a second (retracted) position. The access device (5) is provided with a pair of arms (8) and (9) each pivotally connected at pivots (10) and (11) to a support means, (4) and, to the access member at pivots (12) and (13). The device is configured such that the access member (5) may be retracted while maintaining the second end (7) of the access member (5) elevated relative to the first end (6) of the access member (5). The arms (8) and (9) are pivotally mounted each preferably provided with one or two dogleg bends therein, to facilitate a totally retracted storage position.

4 Claims, 7 Drawing Sheets

ACCESS DEVICE

FIELD OF THE INVENTION

The present invention relates to an access device, such as a ladder and the like, which provides access between a substrate surface and an elevated surface. The present invention, in particular, relates to a movable or retractable access device, which is movable between a first position or storage position and a second position or operable position.

BACKGROUND AND RELATED ART

A variety of different access device configurations for removably or retractably providing an access member between operable and storage positions are presently known. The most well known of these include ladders wherein a portion of the ladder may be extended or caused to slide relative to an adjacent portion of a ladder, or, whereby a ladder is pivoted about one end thereof, between a storage position and an operable position.

Such prior art access devices or ladders have generally operated by air cylinder means or the like, however, the present invention is preferably implemented by utilising an actuator.

SUMMARY OF THE INVENTION

The present invention seeks to provide an access device which may be used in alterative to the above device, and which overcomes certain disadvantages of prior art access devices.

The present invention also seeks to provide an access device which is conveniently raised and lowered taking up minimal space in a storage position, and which is provided in an operable position at any convenient angle which complies with the local relevant standard or regulations.

In one embodiment, the present invention provides an access device adapted to provide access between a substrate surface and an elevated surface, comprising.

- a fixed support means, attached to or integral with said elevated surface;
- an access member movable between a first position wherein a first end of said access member is substantially vertically adjacent to said support means, and, a second position wherein a second end of said access member is substantially vertically adjacent to said support means; and,
- a pair of arms, each arm pivotally connected at a first end thereof to said support means, and, at a second end thereof to said access member, in such a configuration that said access member may be moved between said first and second positions whilst maintaining said second end of said access member elevated relative to said first end of said access member Preferably, said access member is a stairway or ladder comprising a pair of first and second side members having a plurality of steps or cross member disposed between said first and second side members.

Also preferably, one or both of said arms is each provided with at least one dogleg bend therealong.

In a preferred form of the invention said first end of said first arm is pivotally connected to said support means at a more upwardly and rearwardly location relative to said first end of said second arm, and. said second end of said first arm is pivotally connected to a more upward location of said access member relative to said second arm.

Also preferably, said access device further comprises an arm support rail on at least one side of said access devices ladder.

More preferably, in said second position, said access member is inclined at between 60° and 75° relative to a substantially horizontal substrate surface.

Most preferably, in said second position, said access member is inclined at approximately 62° relative to a substantially horizontal substrate surface.

Also preferably, in said first position, said access member is provided substantially vertically, or, at a rearwardly inclined angle.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF PREFERRED EMBODIMENTS

Figure 1:
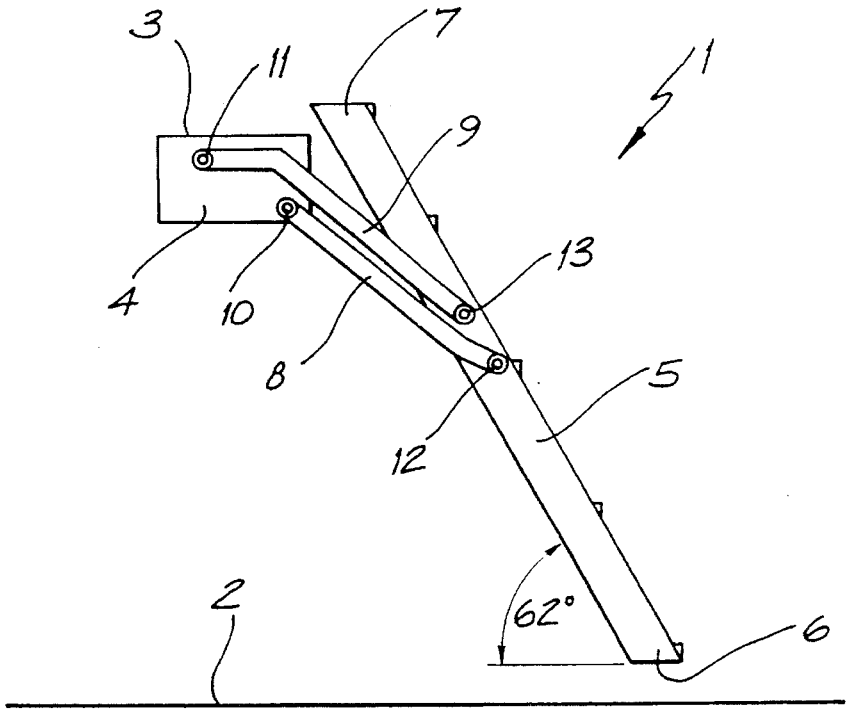
FIG. 1 shows the access device in accordance with the present invention in an operable or second position.

Throughout the drawings, like numerals will be used to identify similar features, except where expressly otherwise indicated.

The access device, as illustrated in the drawings, and generally designated by the numeral 1, provides access between a substrate surface 2 and an elevated surface 3. The access device 1, comprises fixed support means 4, which is either attached to or integral with said elevated surface 3. It also comprises an access member 5 which is movable between the first position shown in FIG. 2, and, the second position shown in FIG. 1 it will be immediately apparent that there is a similarity between the position of the access device illustrated in FIGS. 1, 5 and 7. It will likewise be seen there is a similarity between the positions of the access device shown in FIGS. 2, 4 and 6. That is, FIGS. 1, 5 and 7 all illustrate various embodiments of the access device in the 'downward' or 'operable' position, or, the "second" position. Similarly, FIGS. 2, 4 and 6 illustrate various embodiments of the access device in the 'upward', 'storage' or 'retractable' position, or the "first" position.

As well be seen in FIG. 1, in the downward or operable position, a first end 6 of the access device 5 is provided near to a substrate surface 2, and a second end 7 of the access device 5 is provided substantially adjacent to an elevated surface 3. In a preferred embodiment wherein the access device 5 is embodied as a ladder with a plurality of steps or cross members therealong between the first and second ends 6 and 7 respectively, (note FIGS. 4 and 5) a person may easily obtain access between the substrate surface and the elevated surface 3. Then, after access is obtained, the access device is adapted to be removed or retracted to the first position shown in FIG. 1. Movement may be facilitated either manually, hydraulically, electrically, mechanically, pneumatically or any combination of the aforesaid. Movement is controlled by the provision of a pair of arms 8 and 9, each arm having a first end 10, 11 thereof, respectively, pivotally attached to the support means 4, and a second end 12 and 13 pivotally attached to the access member 5. In use, the access member will be understood to be transferred from the first position 14 to the second position 15, as shown in FIG. 3 via the tangential movement of the second ends of the arms 8 and 9.

Most preferably, when the access device is embodied as a stairway or a ladder, when the ladder is in the operable or downward position, it is adapted to be inclined to the horizontal at an angle of between 60° and 75°, and perhaps most preferably, at an angle of 62°. This allows for easy climbing of the steps provided along the length of the ladder. Other angles of inclination may of course be utilised if a 'rung' ladder rather than a 'step' ladder is embodied, for example, in situations the access device is used for other where uses than for ladders.

Figure 2:
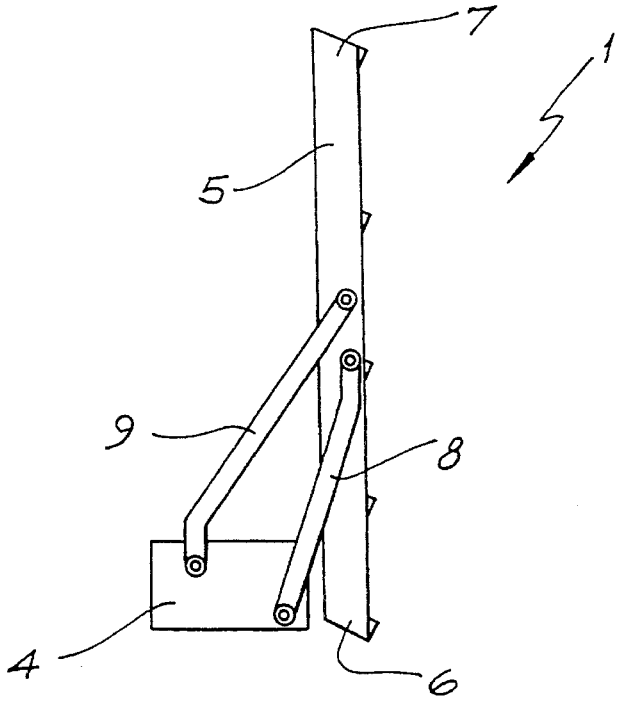
FIG. 2 shows the access ladder in a storage or first position.
Figure 3:
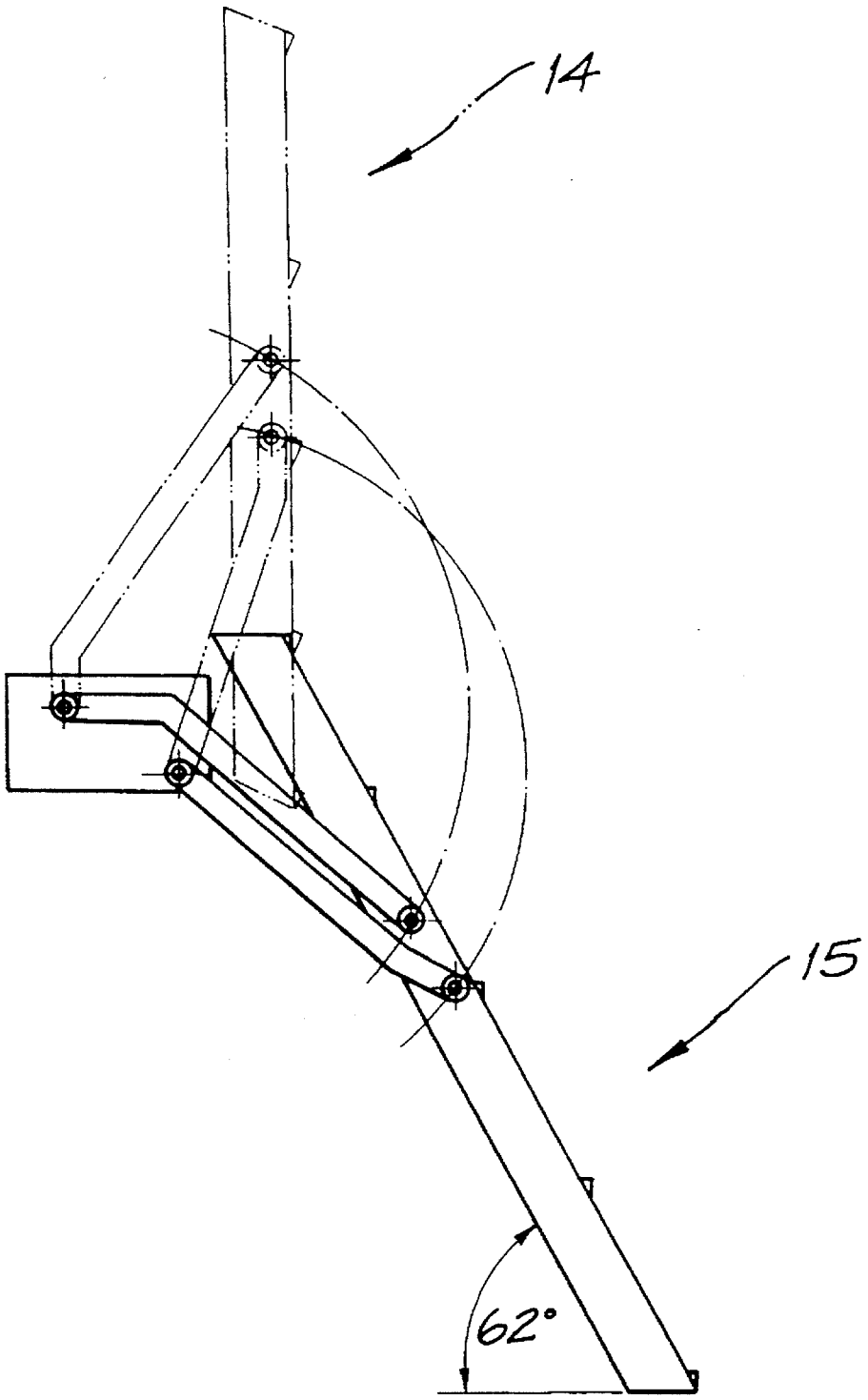
FIG. 3 illustrates the tangential arcs in which the pivotal connections between the arms and the access ladder undergo during movement between said first and second positions.
Figure 4:
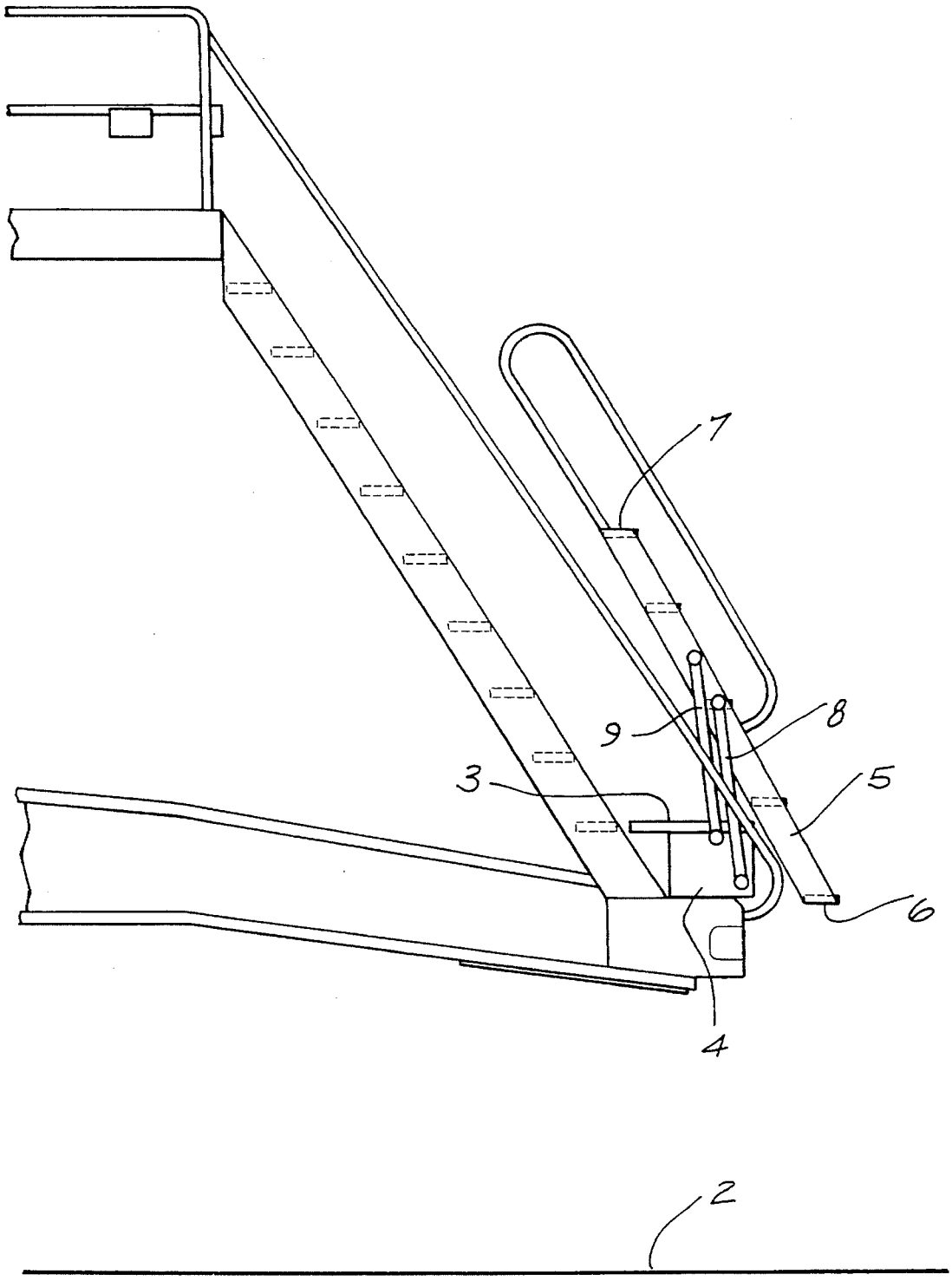
FIG. 4 illustrates an alternative preferred embodiment of the access device, embodied as a ladder, FIG. 4 showing the first position thereof.
Figure 5:
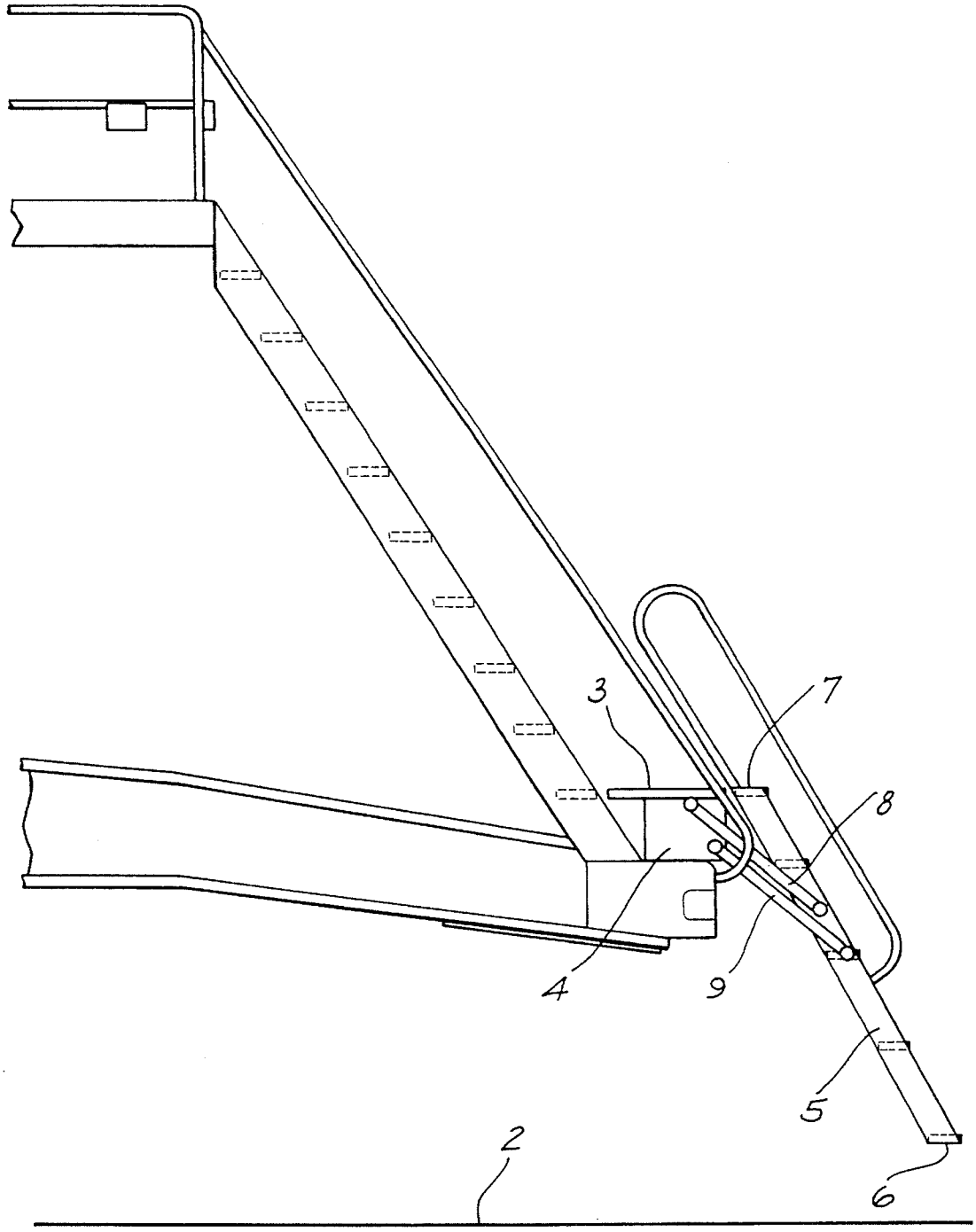
FIG. 5 illustrates said alternative embodiment of the ladder in a second position thereof; The access device includes a pair of spaced side members connected by a plurality of spaced cross members or steps as noted in dotted lines in FIG. 4.
Figure 6:
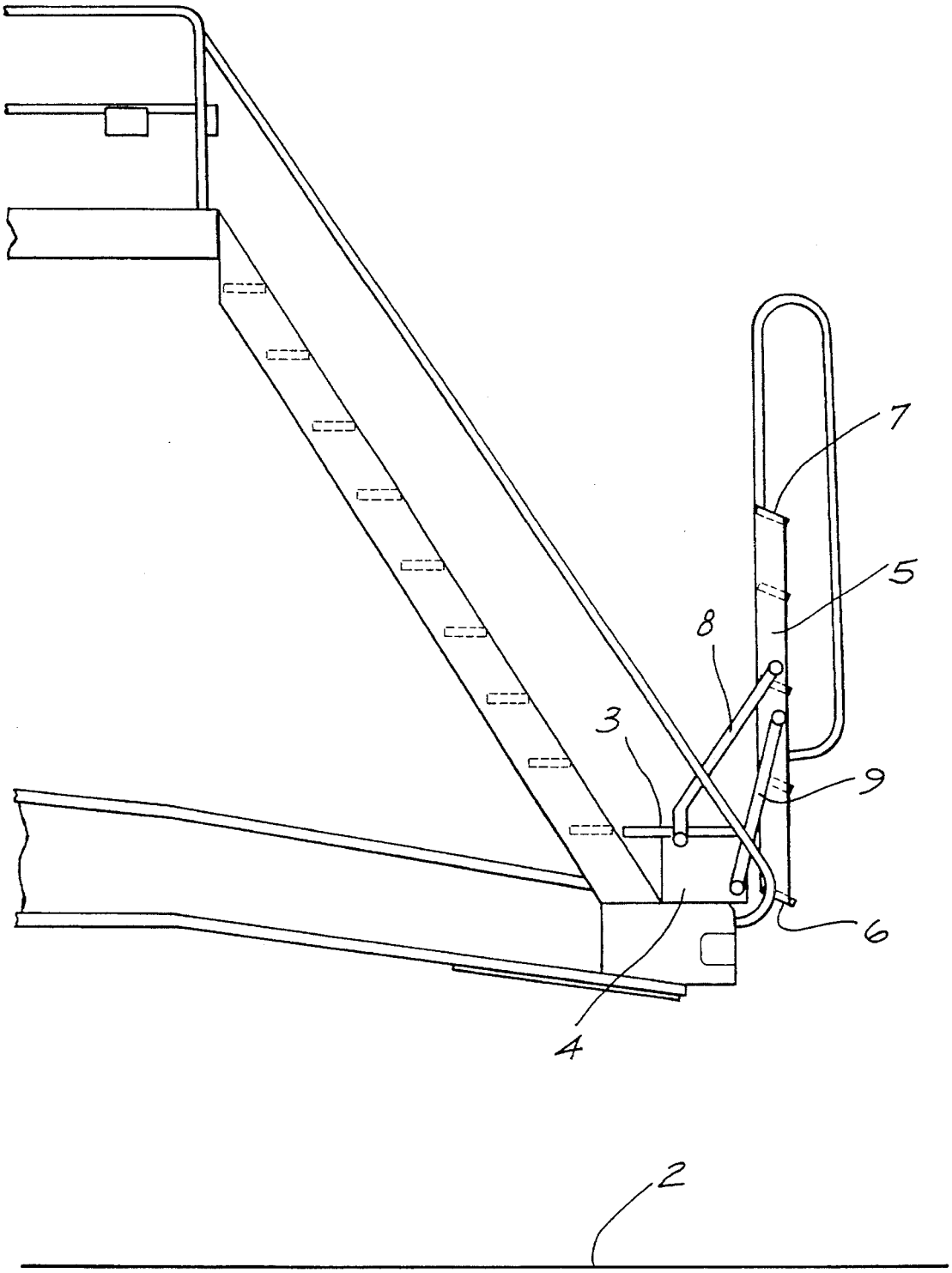
FIG. 6 illustrates yet a further preferred embodiment of the access device embodied as a ladder in a first position thereof.
Figure 7:
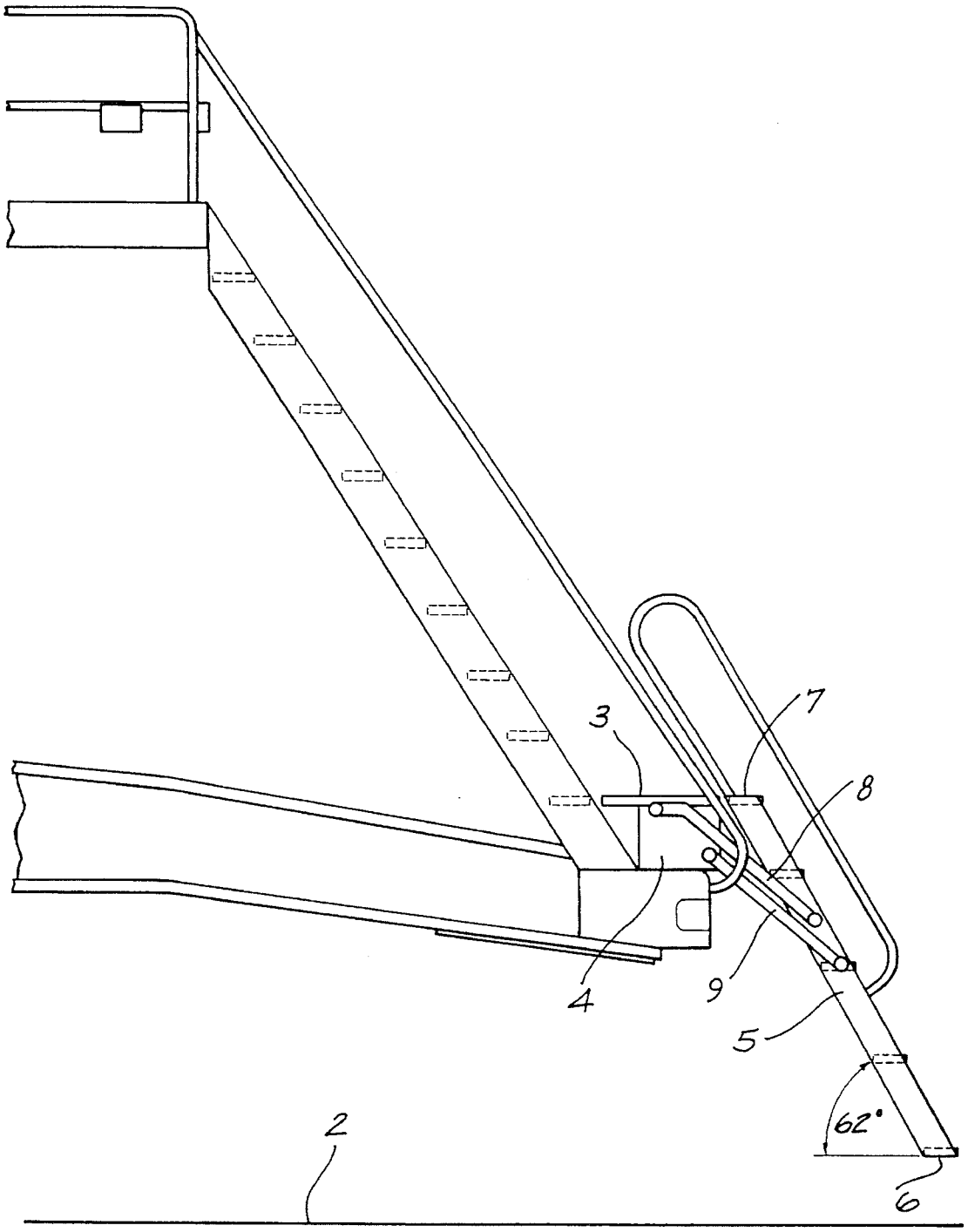
FIG. 7 illustrates the second preferred embodiment of the invention in a second position thereof; and, FIG. 8 illustrates another preferred embodiment of the invention—showing the various positions thereof.
Figure 8:
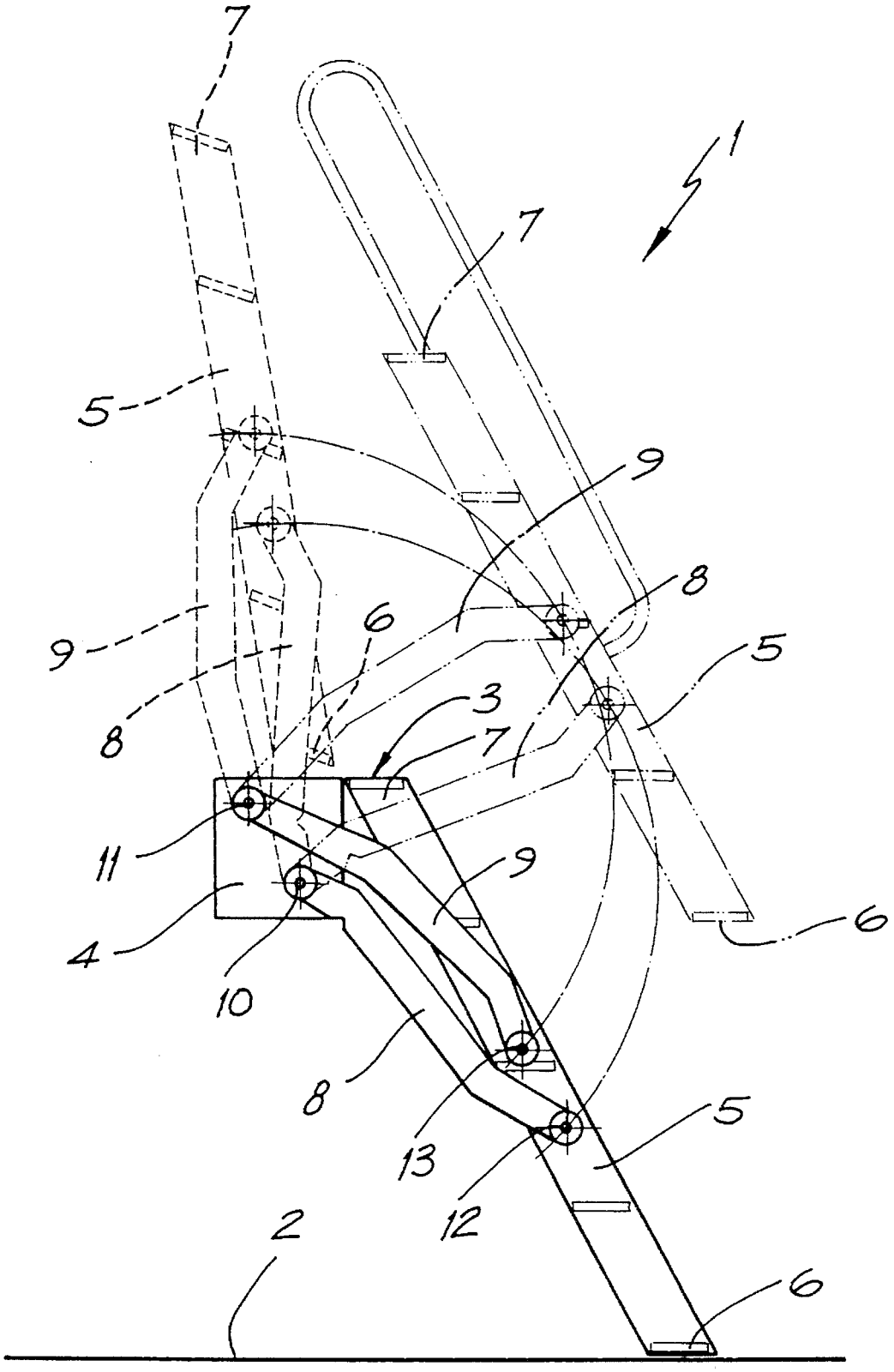

The embodiment shown in FIGS. 4 and 5 and that of FIG. 8, are each not substantially different to the embodiments shown in FIGS. 1 to 3, with the exception that the arms 8 and 9 are embodied as straight 'arms', rather than being of dogleg shape. Differently shaped arms will be understood to be embodied to provide for different angles of inclination of the ladder in the operable and storage positions. For case of understanding and by way of further example, an alternative embodiment is shown in FIGS. 6 and 7, wherein only one of the arms is provided with a dogleg shape. It will be immediately apparent that there is a different storage or first position enabled by the provision of a single upper dogleg arm. In this respect, attention is drawn to the differences in storage positions of the ladder shown in FIGS. 4 and 6. It will be appreciated that the double doglegs provided in the embodiment of FIG. 8 enable the ladder to be provided in a storage position wherein the first end 6 of the ladder 8 is provided totally above the elevated surface 3—i.e. fully retracted.

It will be appreciated that there are a wide variety of applications for such a ladder. It will be apparent that the ladder is adapted to provide access to any type of vehicle, particularly, earth moving equipment wherein a large clearance under a vehicle and typically large vehicles are utilised. Provision of such a ladder will allow for easy access of an operator to the vehicle, but also allow for complete retraction of the ladder out of the way of any earth moving operations.

It will be understood that there are other applications for the device other than as a ladder. For instance, other access devices such as conveyor belts, etc., may be utilised on the access device to provide for easy access between a substrate and an elevated surface.

In summary, the retractable access device enable access between a substantially horizontal substrate surface and an elevated surface. The access device is adapted to cooperate with support means attached or integral with said elevated surface. The access device includes a pair of spaced first and second side members connected by a plurality of spaced cross members or steps extending from the lower end of said access device to an upper end thereof as shown in dotted lines in FIGS. 4 and 5, the upper end of said access device extending adjacent to said support means.

A pair of spaced first and second rigid arms are provided, each pivotally connected to a corresponding side member, wherein one end of said first arm is pivotally connected to said first side member and wherein a corresponding end of said second arm is connected to the second side member, each of said arms being pivotally connected at its other end to said support means, whereby the access device is pivotally movable from a lower position relative to the support means to an upper position adjacent to the support means while maintaining the upper end of the access device in the elevated position relative to the lower end of said access device.

Whilst a particular embodiment of the access device has been hereinbefore described, it will be understood that numerous variations and modifications to such an access device will be envisaged by persons skilled in the art. All such variations and modifications should be considered to fall within the scope of the invention as hereinbefore described, and as hereinafter claimed.

I claim:

1. A retractable access device for providing access between a substrate surface and an elevated surface of a vehicle, comprising, support means attached to or integral with said elevated surface, said access device including a pair of spaced first and second side members connected by a plurality of spaced steps extending from a lower end of said access device to an upper end thereof, a pair of rigid arms provided on each side member of said access device, each arm being pivotally connected at a first end thereof to said support means, and, at second end thereof to said side members, said first end of said first arm being pivotally connected to said support means at more upwardly and rearwardly position relative to said first end of said second arm, and, said second end of said first arm being pivotally connected to a more upward position on said respective side member relative to said second arm, whereby, said device is pivotally movable from a stable lower position to a stable upper position, such that, in said lower position, said access device is inclined at between 60° and 76° relative to a substantially horizontal substrate surface, and, said upper end of said access device is positioned substantially adjacent to and forwardly of said elevated surface, and, wherein, in said upper position, said access device is positioned substantially vertically or at a rearwardly inclined angle in a position which is upward and rearward of said elevated surface.

2. An access device as in claim 1, wherein one or both of said arms is provided with at least one dogleg bend therealong.

3. An access device in claim 1, wherein said access device further comprises an arm support rail disposed adjacent at least one of said side members.

4. An access device as claimed in claim 1, wherein said access member is inclined at approximately 62° relative to a substantially horizontal substrate surface.

* * * * *